US011844485B2

(12) United States Patent
Genn et al.

(10) Patent No.: US 11,844,485 B2
(45) Date of Patent: Dec. 19, 2023

(54) CLEANER HEAD

(71) Applicant: Dyson Technology Limited, Wiltshire (GB)

(72) Inventors: Stuart Lloyd Genn, Swindon (GB); Robert Michael Cox, Warwick (GB); Matthew Jonathan Stubbs, Newport (GB)

(73) Assignee: Dyson Technology Limited, Malmesbury (GB)

( * ) Notice: Subject to any disclaimer, the term of this patent is extended or adjusted under 35 U.S.C. 154(b) by 667 days.

(21) Appl. No.: 16/976,290

(22) PCT Filed: Jan. 17, 2019

(86) PCT No.: PCT/GB2019/050127
§ 371 (c)(1),
(2) Date: Aug. 27, 2020

(87) PCT Pub. No.: WO2019/167760
PCT Pub. Date: Sep. 6, 2019

(65) Prior Publication Data

US 2021/0052120 A1 Feb. 25, 2021

(30) Foreign Application Priority Data

Feb. 28, 2018 (GB) ..... 1803285

(51) Int. Cl.
*A47L 9/06* (2006.01)
*A47L 9/04* (2006.01)

(52) U.S. Cl.
CPC ..... *A47L 9/0666* (2013.01); *A47L 9/0466* (2013.01); *A47L 9/0606* (2013.01)

(58) Field of Classification Search
CPC ..... A47L 9/0626; A47L 9/0606
See application file for complete search history.

(56) References Cited

U.S. PATENT DOCUMENTS 2,511,238 A 6/1950 Beede
2,517,058 A 8/1950 Uber
(Continued)

FOREIGN PATENT DOCUMENTS

CN 101862164 A 10/2010
CN 201912013 U 8/2011
(Continued)

OTHER PUBLICATIONS

Notification of Reasons for Refusal received for Japanese Application No. 2020-542231, dated Sep. 28, 2021, 6 pages (3 pages of English Translation and 3 pages of Original Document).
(Continued)

*Primary Examiner* — Bryan R Muller
(74) *Attorney, Agent, or Firm* — Faegre Drinker Biddle & Reath LLP

(57) ABSTRACT

A cleaner head for a cleaning appliance, the cleaner head comprising: a housing defining a suction chamber; and a sole plate defining a downwardly-directed opening through which dirt can enter the suction chamber. The cleaner head further comprises a hollow deformable seal extending from a rear portion of the housing, the hollow deformable seal having a width at least equal to a width of the opening in the sole plate, and having a lower sealing surface that extends in a downward and rearward direction from a rear edge of the housing such that, in use, the hollow deformable seal is biased against and conforms to a surface being cleaned in order to maintain a seal between the cleaner head and the surface being cleaned.

15 Claims, 7 Drawing Sheets

(56) References Cited

U.S. PATENT DOCUMENTS

| | | | |
|---|---|---|---|
| 4,864,682 | A | 9/1989 | Bewley, Jr. et al. |
| 7,334,284 | B2 | 2/2008 | Grey |
| 2009/0119871 | A1 | 5/2009 | Dilger et al. |
| 2010/0236019 | A1 | 9/2010 | Behrenswerth |
| 2010/0257692 | A1 | 10/2010 | Maguire et al. |
| 2013/0145577 | A1 | 6/2013 | Davidshofer et al. |
| 2015/0074940 | A1 | 3/2015 | Guinot et al. |
| 2015/0135477 | A1 | 5/2015 | Davidshofer et al. |

FOREIGN PATENT DOCUMENTS

| | | | | | |
|---|---|---|---|---|---|
| CN | 103826517 | A | | 5/2014 | |
| CN | 104367268 | A | | 2/2015 | |
| DE | 20118711 | U1 | | 2/2002 | |
| DE | 19900557 | C2 | | 6/2002 | |
| DE | 102014106192 | A1 | * | 11/2015 | ..... A47L 9/0606 |
| DE | 102014106192 | A1 | | 11/2015 | |
| DE | 102015108052 | A1 | * | 11/2016 | ..... A47L 9/0081 |
| EP | 0304609 | A1 | | 3/1989 | |
| EP | 2064979 | A1 | | 6/2009 | |
| EP | 2152135 | B1 | | 12/2011 | |
| EP | 3017742 | A1 | | 5/2016 | |
| GB | 2531089 | A | | 4/2016 | |
| GB | 2542420 | | | 3/2017 | |
| GB | 2542420 | A | * | 3/2017 | ..... A47L 5/30 |
| JP | 05329077 | A | * | 12/1993 | ..... A47L 9/02 |
| JP | H05-329077 | A | | 12/1993 | |
| JP | 07-194509 | A | | 8/1995 | |
| JP | 08-052100 | A | | 2/1996 | |
| JP | 3903308 | B2 | | 4/2007 | |
| JP | 2017-060761 | A | | 3/2017 | |
| JP | 2017-189269 | A | | 10/2017 | |
| KR | 10-0652488 | B1 | | 11/2006 | |
| KR | 10-2014-0066774 | A | | 6/2014 | |
| WO | 2013/027140 | | | 2/2013 | |

OTHER PUBLICATIONS

Office Action received for Korean Patent Application No. 10-2020-7026641, dated Jul. 28, 2021, 9 pages (4 pages of English Translation and 5 pages of Original Document).

International Search Report and Written Opinion dated Apr. 4, 2019, directed to International Application No. PCT/GB2019/050127; 11 pages.

Search Report dated Aug. 21, 2018, directed to GB Application No. 1803285.4; 1 page.

The First Office Action dated Apr. 2, 2021, directed to CN Application No. 201980015763.4; 17 pages.

Communication under Rule 71(3) EPC Received for EP Application No. 19701715, dated Nov. 10, 2021, 6 pages.

* cited by examiner

CLEANER HEAD

REFERENCE TO RELATED APPLICATIONS

This application is a national stage application under 35 USC 371 of International Application No. PCT/GB2019/050127, filed Jan. 17, 2019, which claims the priority of United Kingdom Application No. 1803285.4, filed Feb. 28, 2018, the entire contents of each of which are incorporated herein by reference.

FIELD OF THE DISCLOSURE

The present disclosure relates to a cleaner head, in particular a cleaner head for a vacuum cleaner.

BACKGROUND OF THE DISCLOSURE

There is a constant desire to improve the pickup performance of vacuum cleaners. The cleaner head of a vacuum cleaner plays an important role in the level of dirt pickup that can be achieved. There are a number of ways in which pickup performance can be improved, one of the most important of which is to maintain a decent pressure differential between the inside the cleaner head and the outside of the cleaner head.

However, when a vacuum cleaner is being used, the cleaner head is moved across the surface being cleaned in forwards and backwards strokes, and as the cleaner head moves it may be partially lifted away from the surface during each stroke. This has the effect of reducing the pressure differential, and therefore reducing the pickup performance. The reduction in pressure differential due to separation of the cleaner head from the surface being cleaned may be particularly pronounced if the cleaner head is travelling over uneven surfaces such as heavily textured hard surfaces, or floor transitions such as doorway threshold bars.

SUMMARY OF THE DISCLOSURE

A first aspect of the present invention provides a cleaner head for a cleaning appliance, the cleaner head comprising: a housing defining a suction chamber; and a sole plate defining a downwardly-directed opening through which dirt can enter the suction chamber. The cleaner head further comprises a hollow deformable seal extending from a rear portion of the housing, the hollow deformable seal having a width at least equal to a width of the opening in the sole plate, and having a lower sealing surface that extends in a downward and rearward direction from a rear edge of the housing such that, in use, the hollow deformable seal is biased against and conforms to a surface being cleaned in order to maintain a seal between the cleaner head and the surface being cleaned.

As a result, during use on a floor surface it is easier to main a pressure differential inside the suction chamber compared with the ambient pressure, particularly if the floor surface is not completely flat. This, in turn, will improve the cleaner head's ability to remove dirt and dust from the floor, and the cleaner head can achieve a higher pick up performance. The term "seal" here is not intended to mean airtight, but instead means that there is a restriction of a gap between the cleaner head and a surface being cleaned sufficient to maintain a pressure differential during use.

The hollow deformable seal may extend across the full width of the cleaner head. This can ensure that a sufficient seal is maintained across the whole cleaner head. This is particularly beneficial in a cleaner head where the suction cavity extends across the full width of the cleaner head.

The hollow deformable seal together with a portion of the housing may define a cavity within the hollow deformable seal. As a result, the cavity allows the deformable seal to deform more easily, and the seal is better able to maintain a seal against a floor, particularly if the surface of the floor is uneven.

The hollow deformable seal may be formed of a resilient material. This allows the seal to return to its original position and to provide a biasing force against the floor surface without requiring a separate biasing means such that the seal is pressed against the floor surface during use.

A perimeter edge of the seal may be mounted to the housing. This allows the seal to be fixed to the housing while keeping the seal hollow.

At least part of the perimeter edge of the seal may not be fixed to the housing, such that air is able to enter into and escape from the hollow seal. As a result, air isn't trapped with the seal, causing an increase in pressure as the seal is deformed. Therefore the seal is more easily deformable, and it is better able to conform to a surface being cleaned as the cleaner head travels over it, and a better seal can be achieved between the cleaner head and the surface being cleaned.

In an unbiased position the lower sealing surface may lie at an angle of between 10° and 45° from a plane defined by the sole plate, and may lie at an angle of between 20° and 35° from a plane defined by the sole plate. This lie angle range for the rear seal strikes a good balance of providing enough downwards force to ensure a good seal is maintained, whilst reducing the likelihood that the seal lifts the suction opening away from the surface being cleaned.

The hollow deformable seal may extend partially around a side portion of the suction opening. As a result, the seal additionally conforms to the floor surface partially around the sides of the suction opening, and an even better seal with the surface being cleaned can be achieved.

When in use on a floor surface, the lower sealing surface may be deformed upwards by the floor surface, and the hollow deformable seal may be compressed such that the volume of a cavity within the hollow deformable seal is reduced. As a result, the deformed seal provides a downward force on the floor surface, and the seal can better conform to the floor surface.

The hollow deformable seal may comprise an angled surface extending from the rear edge of the lower sealing surface, the angled surface being angled upwards and rearwards. As a result, the cleaner head is better at passing over low objects such as larger debris, the edges of rugs or transitions between floor types when travelling in a rearward direction, for example during a backwards stroke.

The hollow deformable seal may be formed of thermoplastic polyurethane (TPU). A front edge of the opening of the sole plate may comprise at least one roller. The suction chamber may house a brush bar.

The present invention further provides a vacuum cleaner comprising a cleaner head as described in any one of the preceding statements.

BRIEF DESCRIPTION OF THE FIGURES

In order that the present invention may be more readily understood, embodiments of the invention will now be described, by way of example, with reference to the following accompanying drawings, in which.

DETAILED DESCRIPTION OF THE DISCLOSURE

Directional terminology such as "front" and "rear" are used herein with respect to the forward and rearward stroke directions of the cleaner head during typical use. Similarly, "downward" means in a direction towards a floor surface on which the cleaner head is positioned during a typical cleaning operation.

Figure 1:
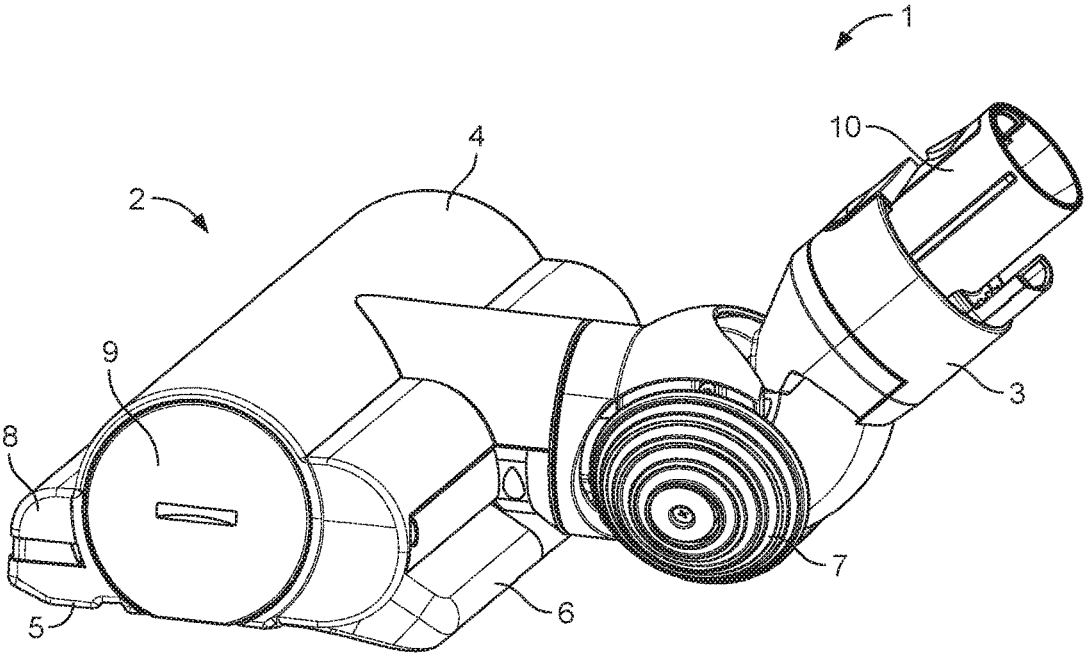
FIG. 1 shows a rear perspective view of a cleaner head.

FIG. 1 shows a cleaner head 1 comprising a head portion 2 and an articulated neck 3 which is rotatably connected to the head portion 2. The head portion 2 comprises a sole plate 5, and a housing 4 which defines a suction chamber inside which a brushbar is housed. A rear seal 6 is located at the rear of the cleaner head such that it extends in a downward and rearward direction from the rear of the housing 4. At the front of the cleaner head 1 attached to the housing 4 is a front edge housing 8. The front edge housing 8 accommodates an actuating mechanism that will described in more detail later. A removable end cap 9 is provided on one side of the housing 4 which provides access to the brushbar when the end cap 9 is removed. The articulated neck 3 comprises wheels 7 which support the cleaner head 1 on a surface being cleaned during use. The articulated neck 3 also comprises a connector portion 10 configured to releasably attach the cleaner head 1 to a vacuum cleaner, typically by way of a wand or a hose.

Figure 2:
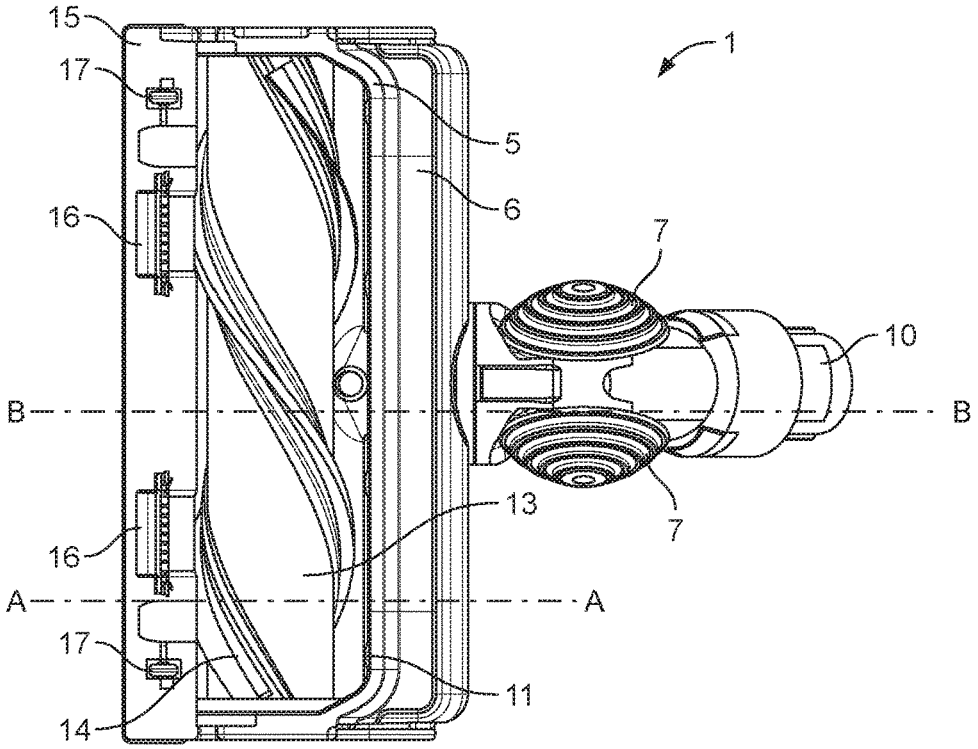
FIG. 2 shows a bottom view of the cleaner head of FIG. 1.

FIG. 2 shows an underneath view of the cleaner head 1. The sole plate 5 defines a downwardly-directed opening 11 through which dirt is able to enter the suction chamber 12 defined by the housing 4. From the view in FIG. 2 the brushbar 13 can be seen, housed within the suction chamber 12. The brushbar 13 is provided with rows of bristles 14 which extend helically around the length of the brushbar 13. The bristles 14 may comprise one or more or a combination of continuous nylon bristles, tufted nylon bristles, and carbon fibre bristles. During use, the brushbar 13 is driven by a motor housed within the brushbar 13 such that dirt and debris is swept by the bristles 14 towards a dirty air outlet through which it leaves the suction chamber and passes through the articulated neck 3.

The front edge housing 8 has a floor-facing surface 15 which forms a front portion of the sole plate 5 forward of the downwardly directed opening 11. Two debris channels 16 (sometimes referred to as large debris channels) are provided in the floor-facing surface 15 which allow larger dirt and debris to enter from the front of the cleaner head 1 into the suction chamber 12. The debris channels 16 will be described in more detail below. Passive rollers 17 are also provided in the floor-facing surface 15 at the front of the sole plate 5. These passive rollers 17 support the cleaner head 1 when in use on a hard floor, ensuring tight control over the separation distance between the hard floor surface being cleaned and the sole plate. The rear seal 6 extends across the full width of the cleaner head 1 behind the suction opening 11.

Figure 3:
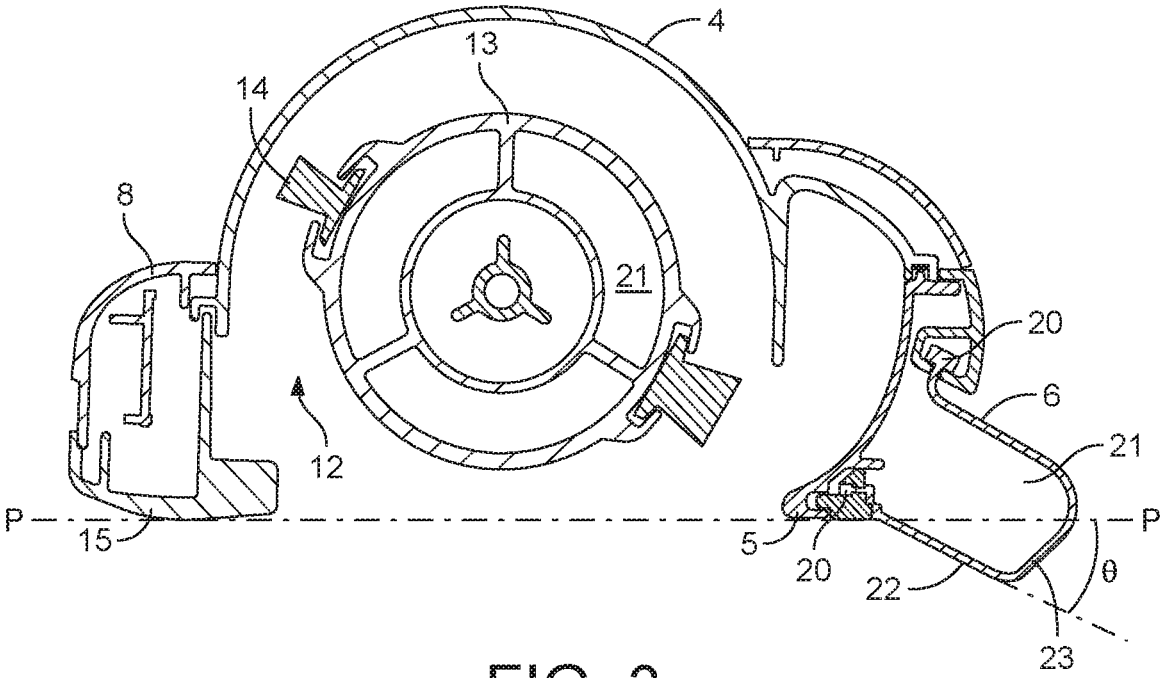
FIG. 3 shows a first cross section through the cleaner head of FIGS. 1 and 2.

FIG. 3 shows a cross section through the cleaner head 1 at the line A-A shown in FIG. 2. The brushbar 13 is housed within the suction cavity 12 defined by the housing 4. At the rear of the housing 4 is the rear seal 6. From the cross section, it can be seen that the rear seal 6 is hollow. A perimeter edge 20 of the seal 6 is mounted to the housing 4, such that the hollow deformable rear seal 6 together with the housing 4 create a cavity 21 within the seal 6. The perimeter edge 20 is clamped to the housing by a mounting bracket, but may be fixed to the housing 4 in other ways, such as by overmoulding the perimeter edge to the housing. The hollow nature of the rear seal 6, and that the rear seal 6 is formed of a resiliently deformable material such as thermoplastic polyurethane (TPU), allows the rear seal 6 to be easily deformable. The rear seal 6 has a lower sealing surface 22 which is the surface that comes into contact with a floor surface on which the cleaner head 1 is positioned. FIG. 3 shows the rear seal 6 in an unbiased position, for example as if the cleaner head 1 is not located on a surface, allowing the rear seal 6 to adopt an unbiased position. In this unbiased position, the lower sealing surface 22 of the rear seal 6 forms an angle θ with a plane defined by the sole plate 5 represented by the dotted line labelled P in FIG. 3. The angle θ is at least 10°, and preferably at least 20°. The angle θ is at most 45°, and preferably at most 35°. In an unbiased position, the lower sealing surface lies at an angle θ of between 10° and 45° from plane P defined by the sole plate 5, and preferably at an angle θ of between 20° and 35° from plane P defined by the sole plate 5.

An angled surface 23 extends in an upwards and rearwards direction from the rear edge of the lower sealing surface 22. This angled surface 23 provides a surface that is better able at riding up and over debris and low obstacles when moving in a rearward direction. As a result, the cleaner head 1 can more easily pass over such obstacles that it may encounter during a backwards stroke of a cleaning operation.

When the cleaner head 1 is placed on a surface, the hollow deformable rear seal 6 deforms allowing the cavity 21 to partially collapse. As the rear seal 6 is formed of a resilient material, the rear seal 6 itself provides a reactionary downwards force across the whole width of the rear seal. As a result, the rear seal 6 is able to conform to any surface on which the cleaner head is placed, thus enabling the cleaner head 1 to achieve a better seal with the surface, and improving the pickup performance during use.

Figure 4:
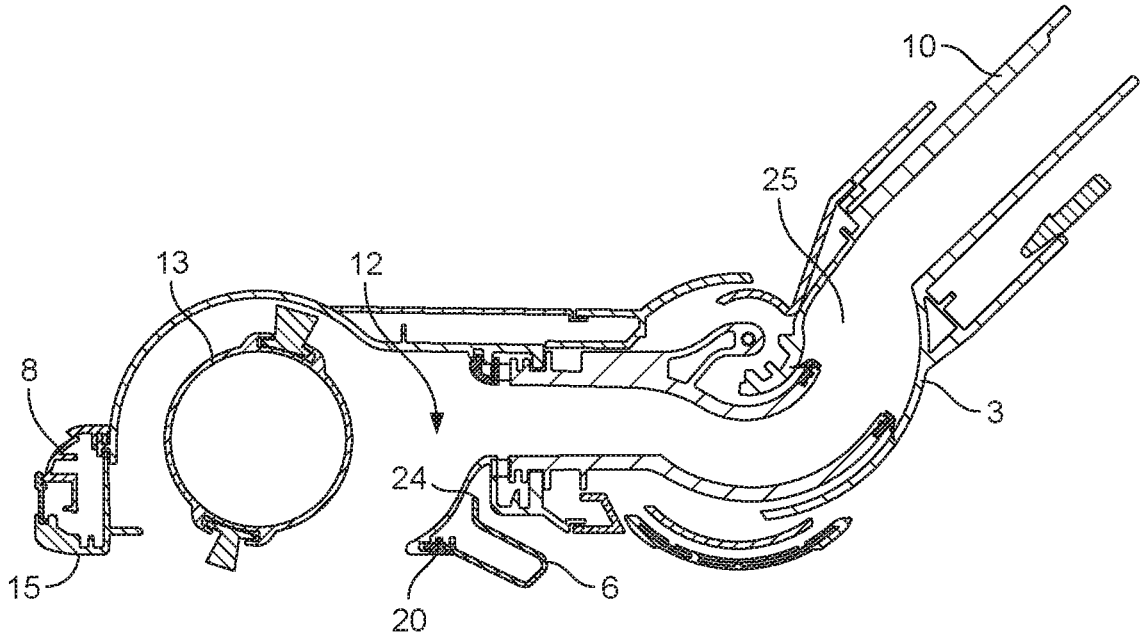
FIG. 4 shows a second cross section through the cleaner head of FIGS. 1 and 2.

FIG. 4 shows a cross section through the cleaner head 1 at the line B-B shown in FIG. 2. This view shows a duct 25 which extends from the suction chamber 12 through the articulated neck 3. When the cleaner head 1 is attached to a vacuum cleaner, dust and dirt agitated and swept up by the brushbar 13 and drawn into the suction chamber 12, the suction generated by the vacuum cleaner then draws a dirty airflow containing the dust and dirt through the duct 25 and into the vacuum cleaner.

At the point that this cross section has been taken through the cleaner head 1 along line B-B, a part 24 of the perimeter edge of the rear seal 6 is not fixed or mounted to the housing 4. As a result, air is able to enter and leave the cavity within the hollow rear seal 6. This means that as the rear seal 6 is deformed, air passes in and out of the hollow deformable rear seal 6. If air was not able to pass freely in and out of the hollow rear seal 6, the air trapped inside would be placed under pressure when the seal deformed, and the rear seal 6 may not be able to conform to the surface as well. In the cleaner head 1 shown in the figures, a part of the perimeter edge 20 of the rear seal 6 is not fixed to the housing 4 in a central area, underneath where the neck 3 connects to the housing 4. The neck 3 therefore affords some protection to the part of the rear seal 6 which is not mounted to the housing, and reduces the likelihood of the free part 24 of the perimeter edge 20 from being snagged during use, causing damage to the rear seal 6.

Figure 5:
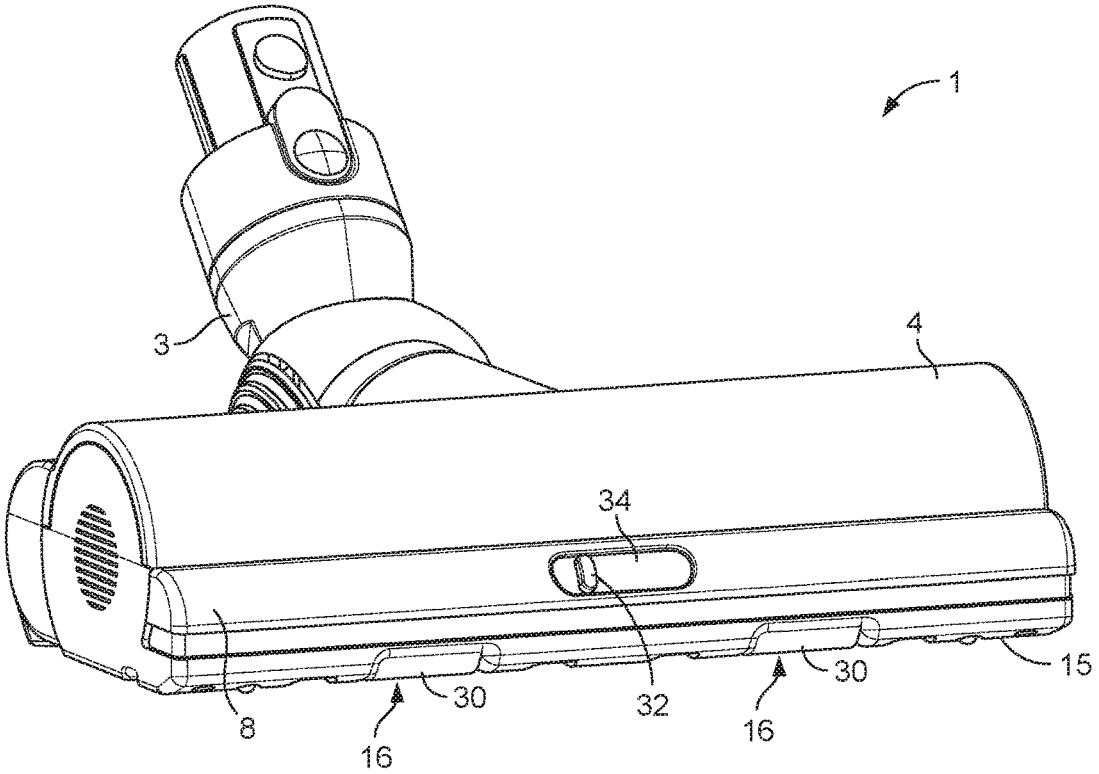
FIG. 5 shows a front perspective view of the cleaner head of FIGS. 1 and 2.

FIG. 5 shows a front perspective view of the cleaner head 1 of FIGS. 1 and 2. Two large debris channels 16 can be seen formed in the floor-facing surface 15 of the front edge housing 8. Inside the large debris channels 16 are actuatable gates 30 which can be raised or lowered to open or close the large debris channels 16. When the actuatable gates 30 are opened, larger items of dirt and debris are able to pass through the channels 16 and enter into the suction chamber to be picked up by the cleaner head 1. However, having the actuatable gates 30 open can reduce the pressure differential between the inside the suction chamber and the outside of the cleaner head 1, which may have a negative impact on the pickup performance of the cleaner head 1. To increase the pressure differential again, the actuatable gates 30 can be lowered such that they block the large debris channels 16.

Figure 6A:
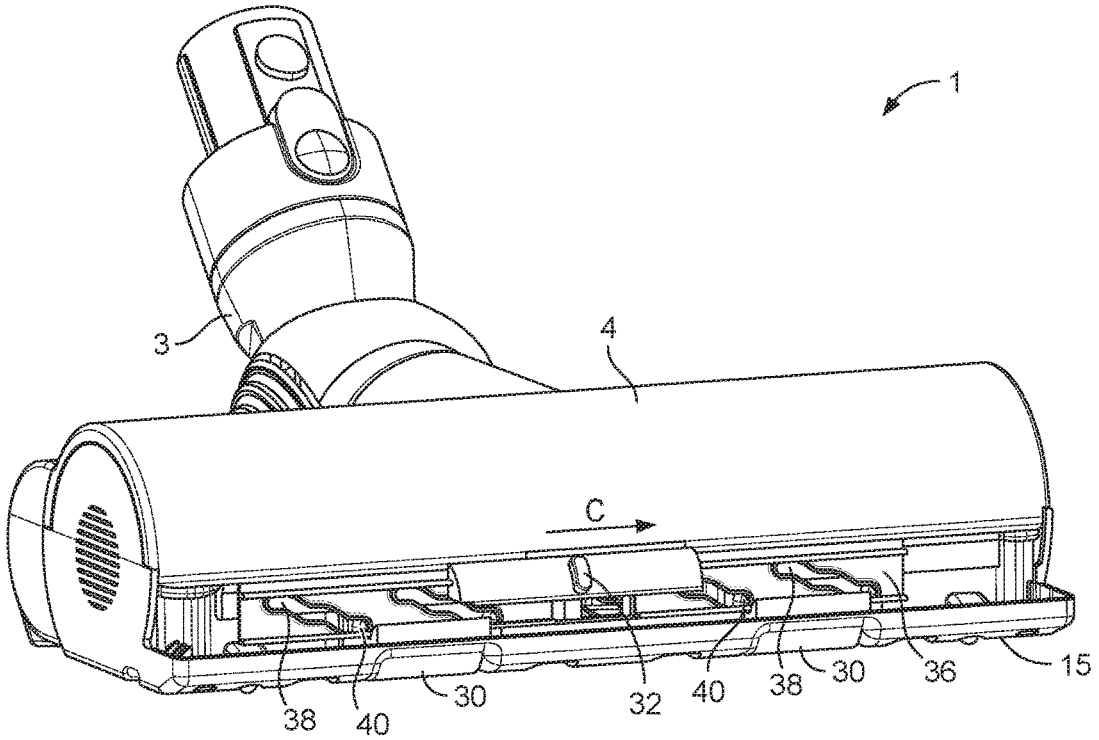
FIGS. 6A, 6B and 6C show the cleaner head of FIG. 5 with a part removed to reveal an actuating mechanism.
Figure 6B:
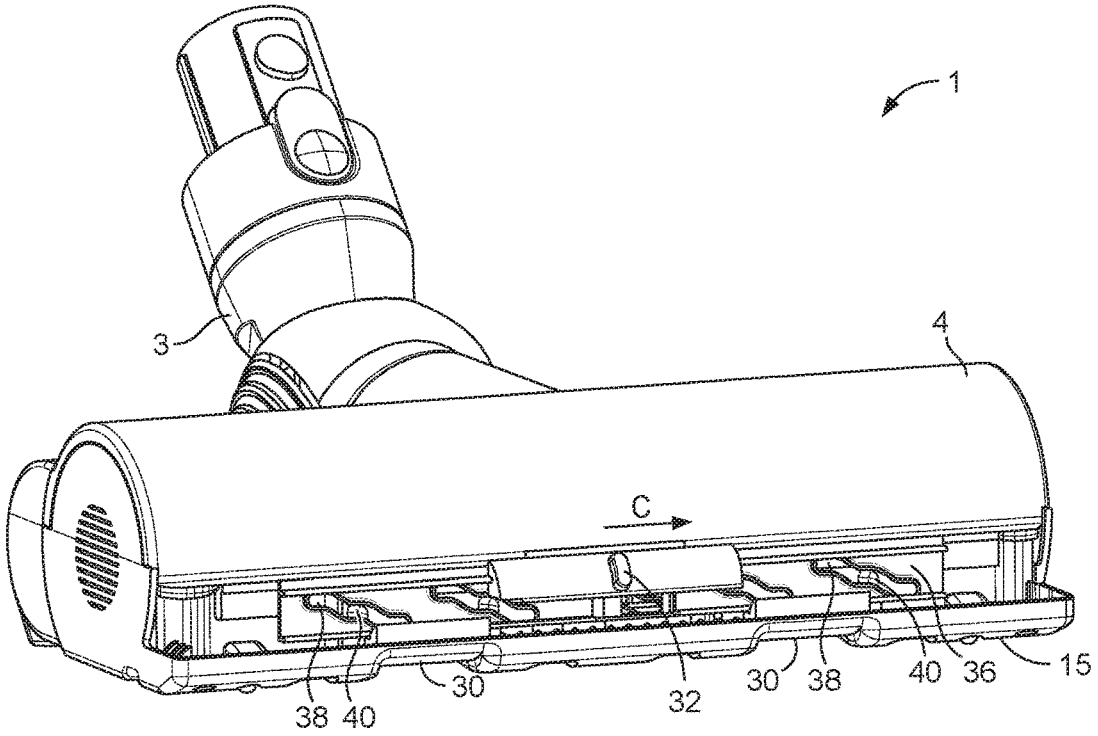
Figure 6C:
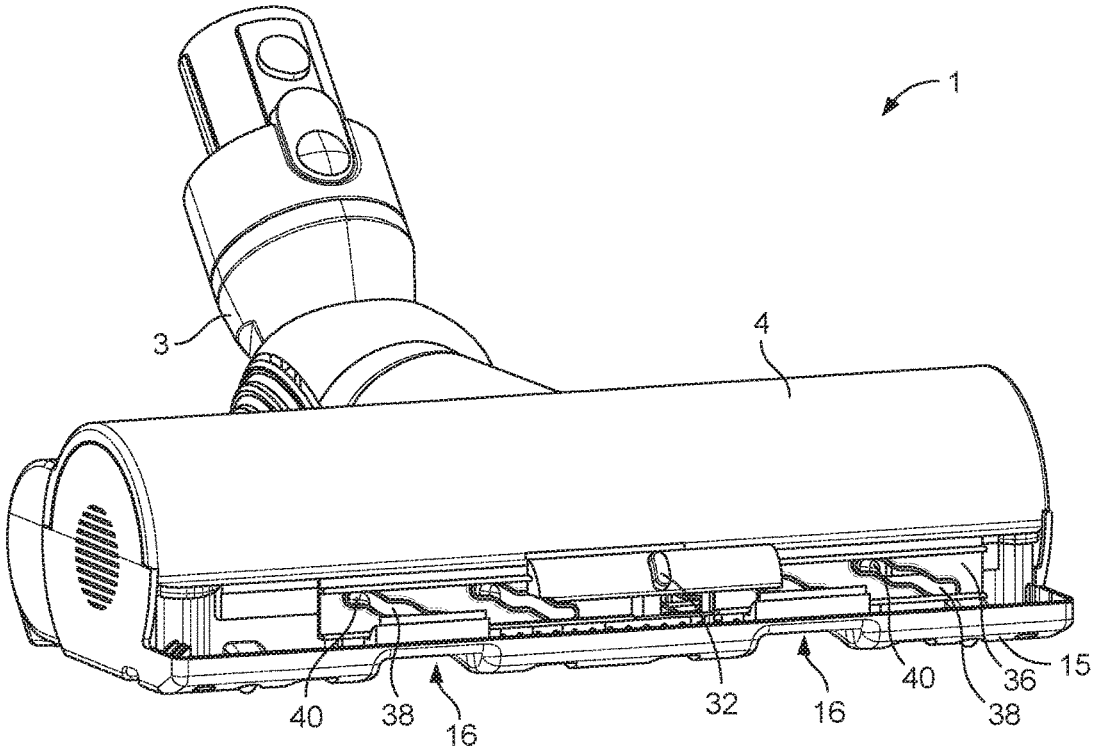

An actuator 32 which protrudes through a window 34 in the front edge housing 8 can be used to raise and lower the actuatable gates 30. FIGS. 6A, 6B and 6C show the cleaner head of FIG. 5 with a part of the front edge housing 8 removed such that the actuating mechanism housed therein can be seen. The actuating mechanism comprises a plate 36 with a number of tracks 38 formed therein. The actuator 32 is fixed to the plate 36 such that a user can use the actuator 32 to slide the plate 36 left and right. Each of the actuatable gates 30 are provided with two protrusions 40 which slidably engage in the tracks 38 in the plate 36. As the plate 36 is slid left and right, the protrusions slide within the tracks 38, causing the gates to be raised or lowered. The tracks 38 are provided with three interval levels which the protrusions are able to stop at, such that the actuatable gates 30 have three positional settings: completely open, halfway closed, or completely closed. Of course, the tracks 38 could be provided with more interval levels should it be desired that the actuatable gates 30 have more positional settings.

In FIG. 6A the actuatable gates are completely closed. By moving the actuator 32 in the direction of arrow C, the protrusions 40 on the actuatable gates 30 are forced to follow the tracks 38 until they reach the middle level of the tracks 38, drawing the actuatable gates 30 upwards. This is shown in FIG. 6B. At this point, the actuatable gates 30 are half opened. By then continuing to move the actuator 32 in the direction of arrow C, the protrusions 40 on the actuatable gates 30 are forced to follow the tracks 38 until they reach the top level of the tracks 38, drawing the actuatable gates further upwards. This is shown in FIG. 6C. At this point, the actuatable gates 30 are completely opened, and the large debris channels 16 are open. Moving the actuator 32 in an opposite direction to arrow C will reverse the direction, and cause the actuatable gates 30 to be lowered again.

Figure 7:
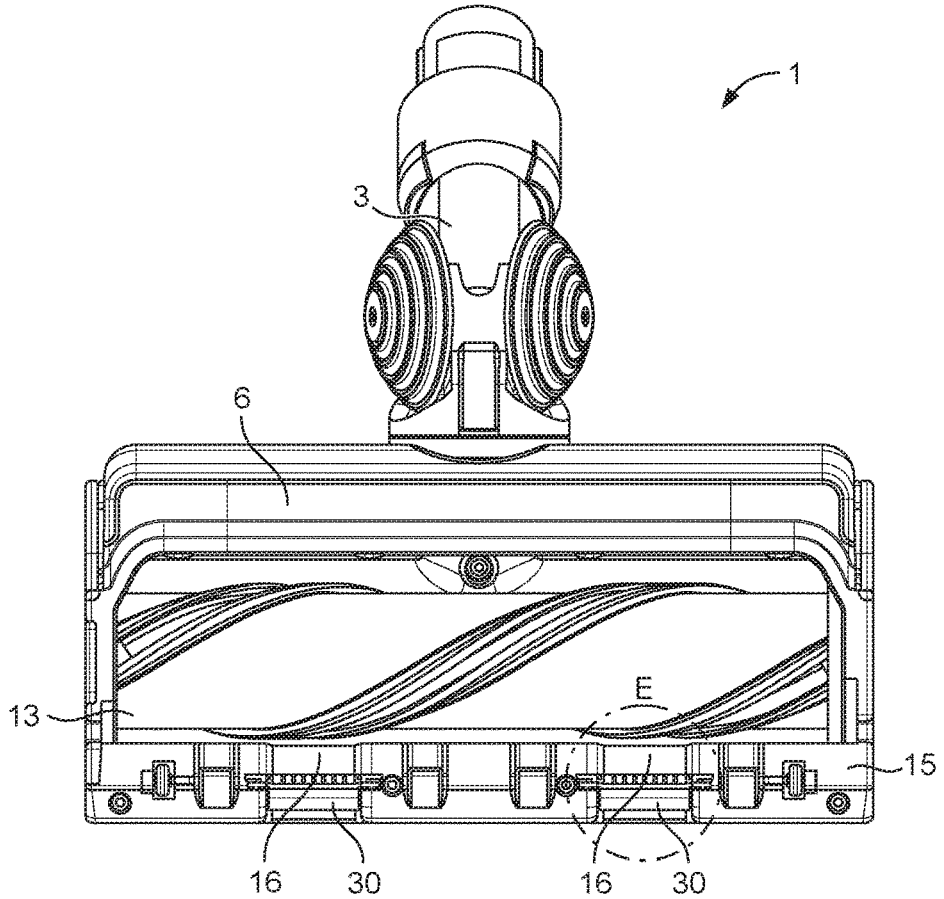
FIG. 7 shows a bottom view of a cleaner head.
Figure 8A:
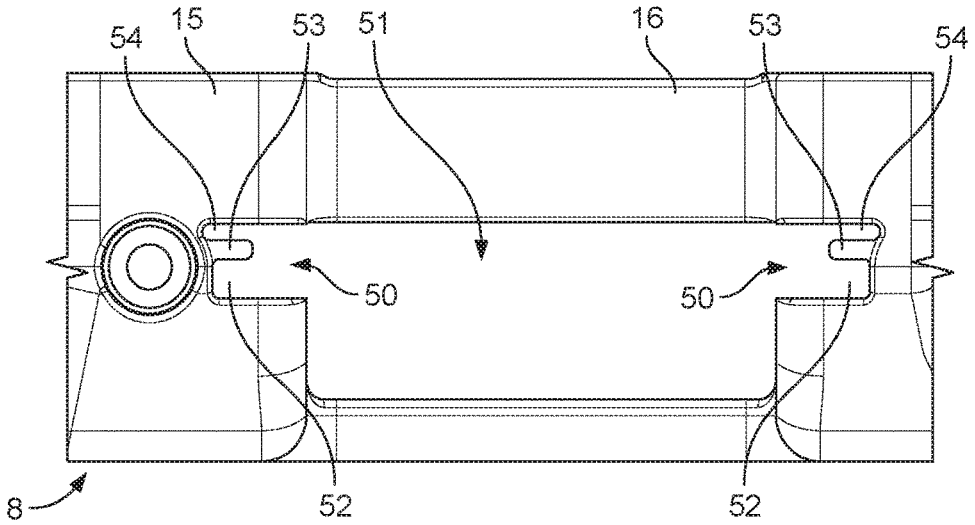
FIGS. 8A and 8B show a large debris channel part of the cleaner head of FIG. 7.
Figure 8B:
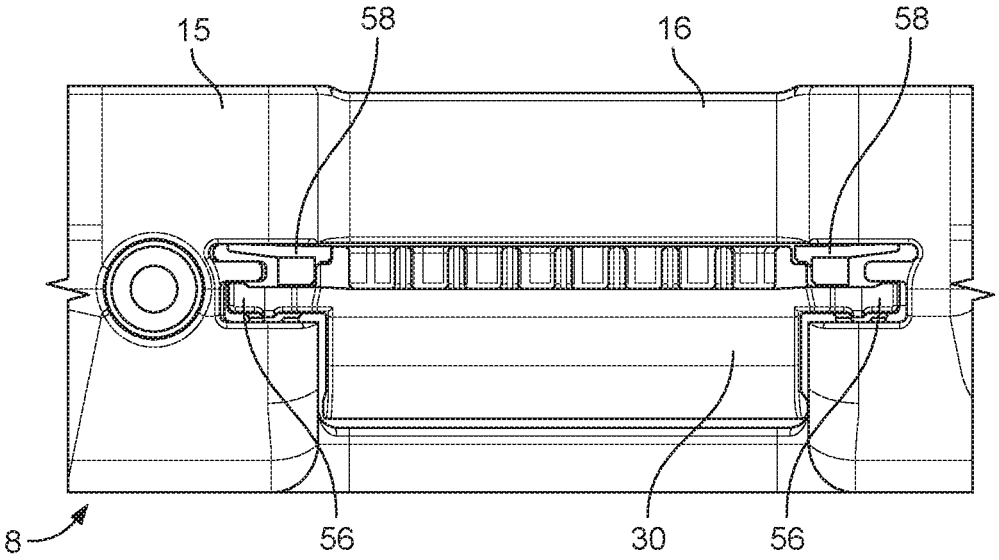
Figure 9:
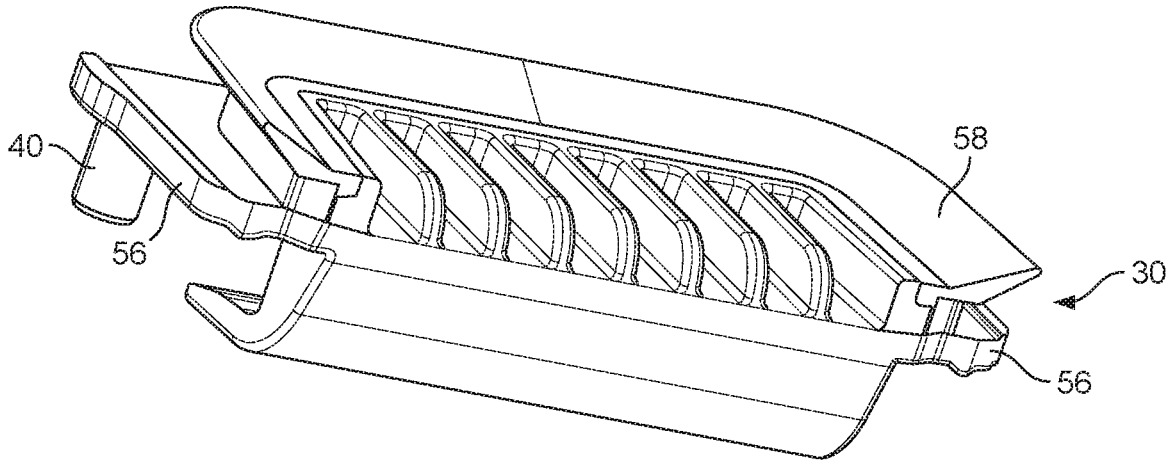
FIG. 9 shows an actuatable gate used for opening and closing the large debris channel of FIGS. 8A and 8B.

FIGS. 8A and 8B show in more detail the large debris channel 16 highlighted in the area marked E in FIG. 7. FIG. 7 shows a cleaner head 1 comprising two large debris channels 16, and each large debris channel comprises an actuatable gate 30. Both of the actuatable gates 30 are actuated by a single actuator 32, as previously described with respect to FIGS. 5, and 6A-C. FIG. 9 shows an actuatable gate 30. In FIG. 8A the actuatable gate 30 has been removed from view. The large debris channel 16 is formed in the floor-facing surface 15 of the front edge housing 8. The front edge housing has a gate cavity 51 which accommodates the actuatable gate 30. The gate cavity 51 comprises a guide channel 50. The actuatable gate 30 comprises a guide flange 56 which slidably engages within the guide channel 50 such that the guide flange 56 slides up and down within the guide channel 50 as the actuatable gate is raised and lowered. The actuatable gate 30 comprises two protrusions 40, one of which can be seen in FIG. 9 which engage within the track 38 in the plate 36 on the actuating mechanism previously described. The actuatable gate 30 further comprises a gate seal 58 which seals against part of the front edge housing 8. By sealing against the front edge housing 8 the gate seal 58 helps reduce air leakage around the actuatable gate 30. Any such air leakage could reduce the pressure differential between the inside of the suction chamber and the outside of the cleaner head 1. The gate seal 30 therefore is important to maximise the pickup performance of the cleaner head 1.

The gate seal 30 is overmoulded to the rest of the actuatable gate 30 on part of the guide flange 56, and is formed of lubricated polyester thermoplastic polyurethane (TPU), however an alternative rubber material may be used instead. The guide channels 50 run through the front edge housing 8 in a direction that is orthogonal to the direction that the large debris channel 16 extends. The guide channels 50 comprise a first section 52 and a second section 54 which are separated by a protruding rib 53. The guide flanges 56 slide through the first sections 52 of the guide channels 50, and the gate seals 58 slide through the second sections 54 of the guide channels 50.

Figure 10:
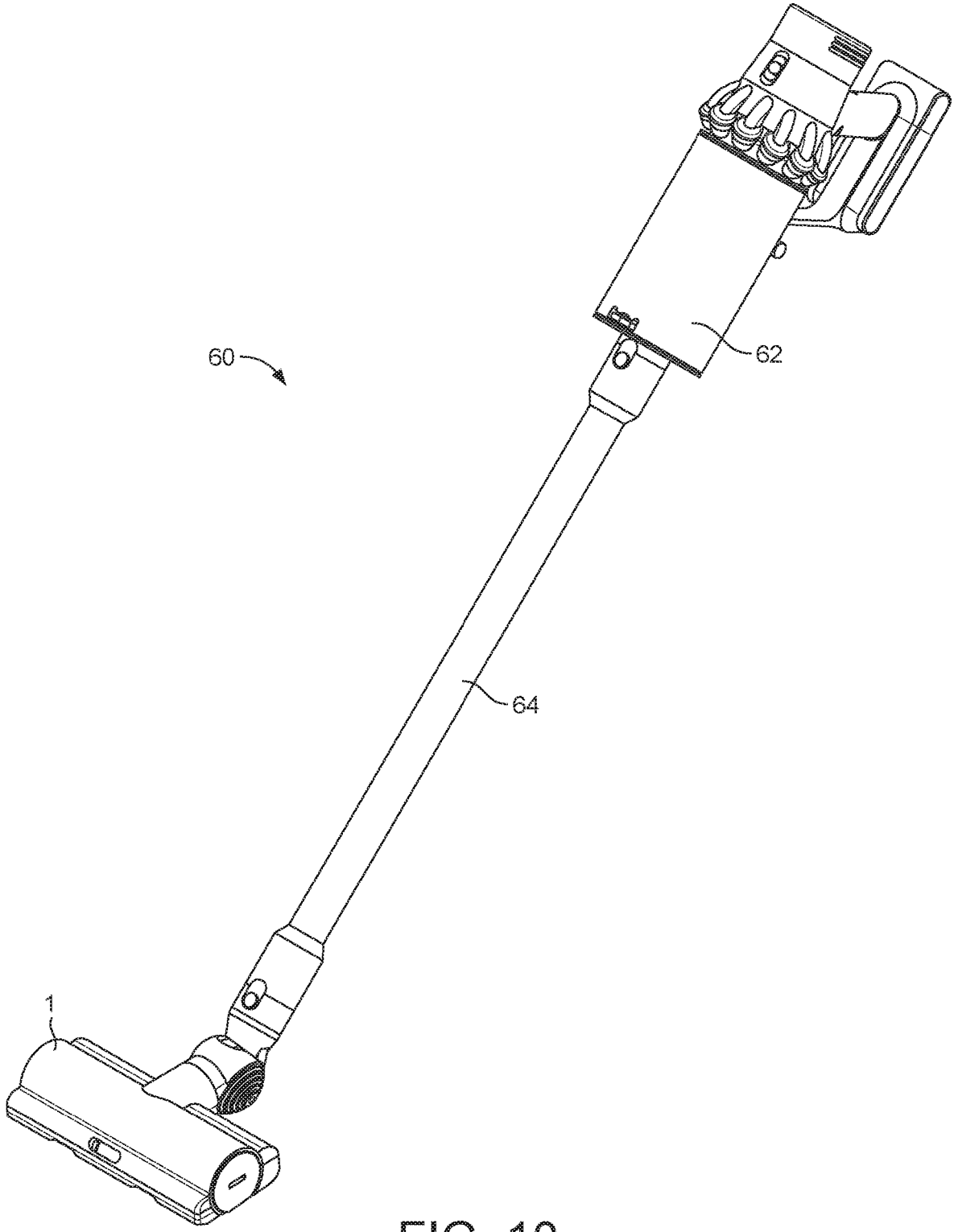
FIG. 10 shows a vacuum cleaner comprising the cleaner head shown in the previous figures.

FIG. 10 shows a vacuum cleaner in the form of a stick vacuum cleaner 60 which comprises the cleaner head 1 previously described. The stick vacuum cleaner 60 is formed of a handheld vacuum cleaner 62 attached to a first end of wand 64. The cleaner head 1 is attached to the second end of wand 64. The embodiment shown is a stick vacuum cleaner 60, however the cleaner head 1 could be used on other types of vacuum cleaner, for example an upright vacuum cleaner or a cylinder vacuum cleaner, which is sometimes referred to as a canister or barrel vacuum cleaner. In addition, the cleaner head, or aspects thereof, could be used in conjunction with the cleaner head for a robot vacuum.

Whilst particular embodiments have thus far been described, it will be understood that various modifications may be made without departing from the scope of the invention as defined by the claims.

For example the cleaner head may be provided with just one large debris channel, or more than two. The embodiments described herein describe two large debris channels being actuated together by a single actuating mechanism, however each large debris channel could be provided with its own actuating mechanism to give the user individual control over opening and closing the large debris channels.

The invention claimed is:

1. A cleaner head for a cleaning appliance, the cleaner head comprising:

a housing defining a suction chamber; and a sole plate defining a downwardly-directed opening through which dirt can enter the suction chamber;

wherein the cleaner head further comprises a hollow deformable seal extending from a rear portion of the housing, the hollow deformable seal having a width at least equal to a width of the opening in the sole plate, and having a substantially planar lower sealing surface that extends in a downward and rearward direction from a rear edge of the housing to a lower edge of the hollow deformable seal such that, in use, the hollow deformable seal is biased against and conforms to a surface being cleaned in order to maintain a seal between the cleaner head and the surface being cleaned.

2. The cleaner head of claim 1, wherein the hollow deformable seal extends across the full width of the cleaner head.

3. The cleaner head of claim 1, wherein the hollow deformable seal together with a portion of the housing defines a cavity within the hollow deformable seal.

4. The cleaner head of claim 1, wherein the hollow deformable seal is formed of a resilient material.

5. The cleaner head of claim 1, wherein a perimeter edge of the seal is mounted to the housing.

6. The cleaner head of claim 5, wherein at least part of the perimeter edge of the seal is not fixed to the housing, such that air is able to enter into and escape from the hollow seal.

7. The cleaner head of claim 1, wherein in an unbiased position the lower sealing surface lies at an angle of between 10° and 45° from a plane defined by the sole plate.

8. The cleaner head of claim 7, wherein in an unbiased position the lower sealing surface lies at an angle of between 20° and 35° from a plane defined by the sole plate.

9. The cleaner head of claim 1, wherein the hollow deformable seal extends partially around a side portion of the suction opening.

10. The cleaner head of claim 1, wherein, when in use on a floor surface, the lower sealing surface is deformed upwards by the floor surface, and the hollow deformable seal is compressed such that the volume of a cavity within the hollow deformable seal is reduced.

11. The cleaner head of claim 1, wherein the hollow deformable seal comprises an angled surface extending from the rear edge of the lower sealing surface, the angled surface being angled upwards and rearwards.

12. The cleaner head of claim 1, wherein the hollow deformable seal is formed of thermoplastic polyurethane (TPU).

13. The cleaner head of claim 1, wherein a portion of the sole plate either in front of or adjacent to a front edge of the opening of the sole plate comprises at least one roller.

14. The cleaner head of claim 1, wherein the suction chamber houses a brush bar.

15. A vacuum cleaner comprising the cleaner head of claim 1.

* * * * *